US005249255A

United States Patent [19]

Fuqua et al.

[11] Patent Number: 5,249,255

[45] Date of Patent: Sep. 28, 1993

[54] RESIN CURING APPARATUS AND METHOD UTILIZING INFRARED LAMP AND BLOWER CONTROL MEANS

[75] Inventors: Rick L. Fuqua, Chicago; Phil Motev, Deerfield, all of Ill.

[73] Assignee: Wisconsin Automated Machinery Corporation, Oshkos, Wis.

[21] Appl. No.: 773,486

[22] Filed: Oct. 9, 1991

Related U.S. Application Data

[63] Continuation-in-part of Ser. No. 592,185, Oct. 3, 1990, abandoned.

[51] Int. Cl.[5] ..... B41F 15/06; B41F 15/10; F26B 3/30

[52] U.S. Cl. ..... 392/412; 392/415; 392/418; 219/388; 101/115; 101/487; 34/1 W; 34/1 BB; 34/39; 34/62; 34/48

[58] Field of Search ..... 392/412–418; 219/388; 101/115, 114, 424.1, 416.1, 126, 129, 487, 488; 34/4, 39, 41, 62, 48, 1 W, 1 BB

[56] References Cited

U.S. PATENT DOCUMENTS

| | | | |
|---|---|---|---|
| 2,048,777 | 7/1936 | Brown | 392/411 |
| 3,465,204 | 9/1969 | Michalski | 315/117 |
| 3,854,398 | 12/1974 | Martin | 101/126 |
| 3,894,343 | 7/1975 | Pray et al. | 392/412 |
| 4,032,817 | 6/1977 | Richmond | 315/157 |
| 4,169,007 | 9/1979 | Pray | 34/4 |
| 4,202,112 | 5/1980 | von der Eltz et al. | 34/4 |
| 4,474,109 | 10/1984 | Yara | 101/424.1 |
| 4,526,101 | 7/1985 | Ericsson | 34/4 |
| 4,545,131 | 10/1985 | Ericsson | 34/4 |
| 4,665,627 | 5/1987 | Wilde et al. | 34/4 |
| 4,671,174 | 6/1987 | Tartaglia et al. | 101/115 |
| 4,773,167 | 9/1988 | Jacobi, Jr. | 34/4 |
| 4,783,908 | 11/1988 | Pabst | 34/4 |
| 4,813,153 | 3/1989 | Palmer et al. | 34/48 |
| 5,050,232 | 9/1991 | Bergman et al. | 392/412 |
| 5,136,938 | 8/1992 | Pellegrina | 101/115 |

FOREIGN PATENT DOCUMENTS 1523023 7/1978 United Kingdom .

*Primary Examiner*—Bruce A. Reynolds
*Assistant Examiner*—John A. Jeffery
*Attorney, Agent, or Firm*—Fitch, Even, Tabin & Flannery

[57] ABSTRACT

A portable resin curing apparatus is used for curing or drying materials printed on a screen press which has rotatable platens carrying screen printed sheets from a printing station to a curing station. The portable curing apparatus is located at the curing station and has electrical resistance heating elements alternating between low voltage and high voltage in conjunction with a forced air flow between the heating elements and printed material being cured. A controller is employed which sends an electrical signal upon advancement of the printed materials. Full curing voltage with no forced air flow is supplied to the heating elements during curing operations, whereas a lower voltage in combination with forced air flow is employed during the intervals between successive curing operations to prevent heat from continuing to be imparted to the printed material while still allowing for rapid re-attainment of full curing upon resumption of production.

13 Claims, 8 Drawing Sheets

FIG. 2
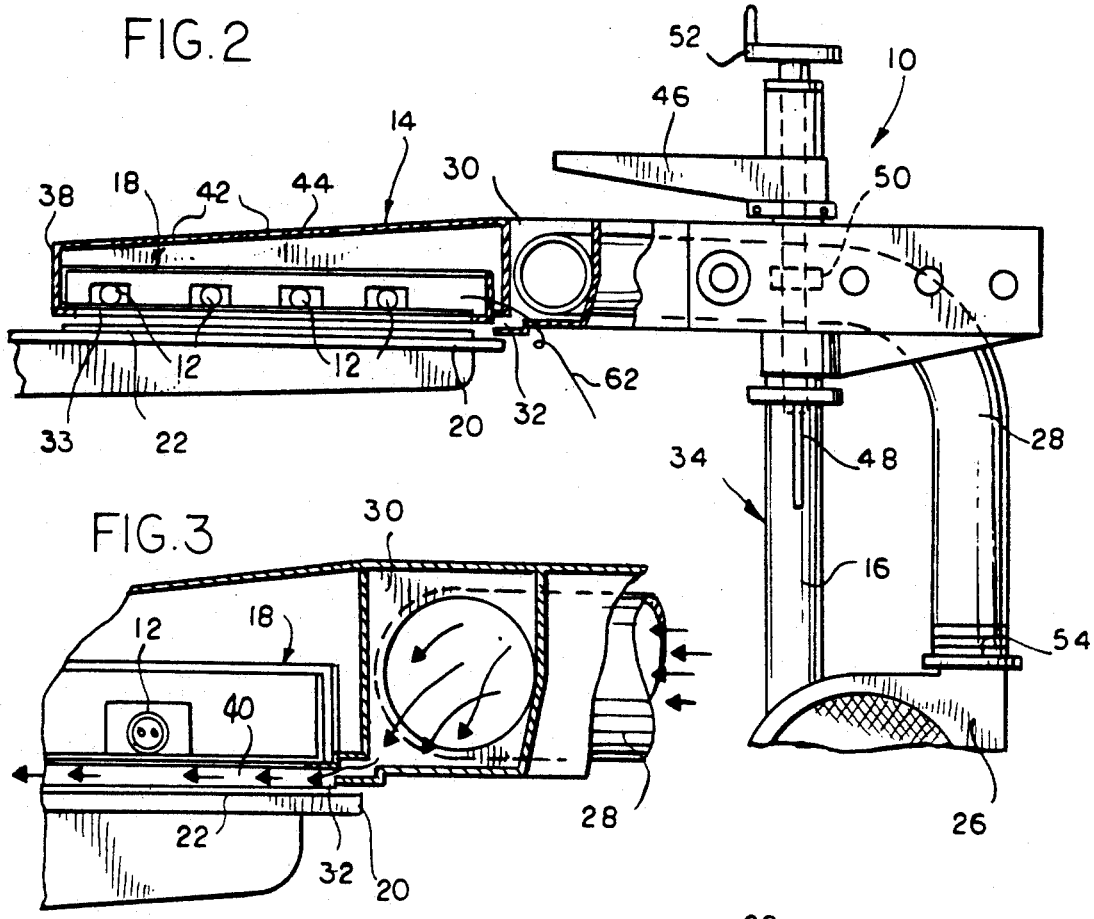
FIG. 3
FIG. 4
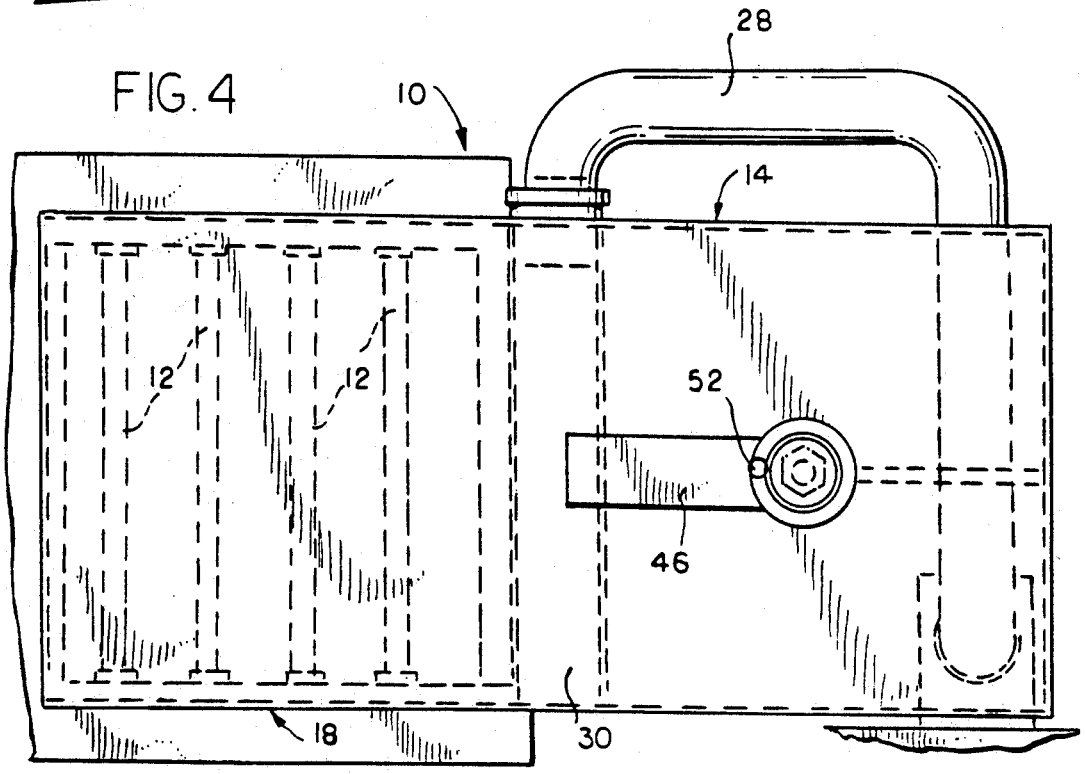

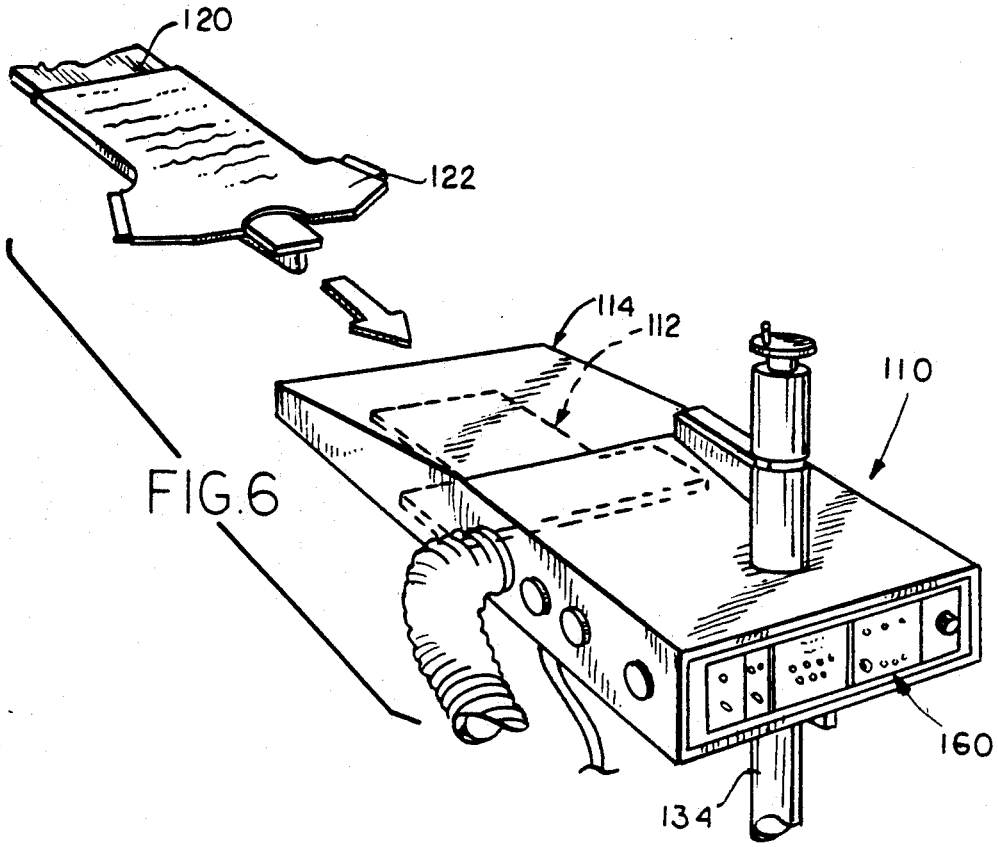
FIG.6
FIG.7.
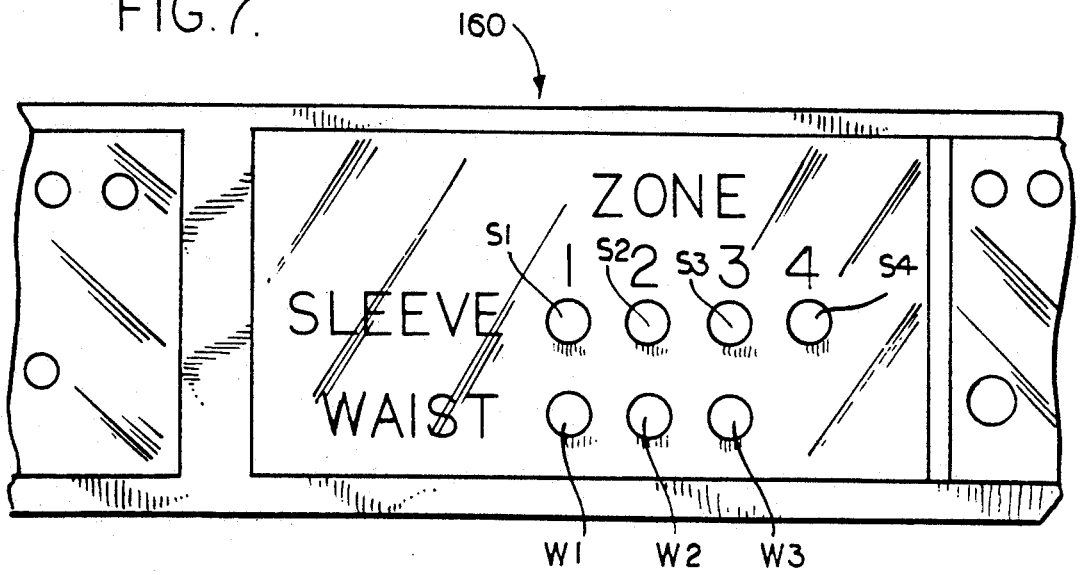

RESIN CURING APPARATUS AND METHOD UTILIZING INFRARED LAMP AND BLOWER CONTROL MEANS

CROSS-REFERENCE TO RELATED APPLICATION

This is a continuation-in-part of co-pending U.S. patent application Ser. No. 592,185 filed Oct. 3, 1990, abandoned, which is hereby incorporated by reference as if fully reproduced herein.

FIELD OF THE INVENTION

This invention relates to an apparatus and method for drying or curing inks, and more particularly, to an apparatus and method for utilizing electrical resistance heating and directed airflow to dry or cure screen printed ink on a material such as a textile.

DESCRIPTION OF RELATED ART

Conventional silk screen presses print multi-colored images on material by mounting the material to a platen and rotating the platen past each of a plurality of print units, located peripherally about a central support, wherein each print unit prints a different color. The images printed at the several print units, when superimposed one over the other on the material, produce the desired multi-colored work. It is important in multi-colored apparatus of this type to completely cure, or dry, the ink applied at a previous station prior to application of a differently colored ink at a subsequent station. Curing between successive ink applications is sometimes necessary or desirable in order to avoid smearing or blurring of the previously printed image upon printing of a subsequent image thereupon. It is known to utilize electrical resistance heating elements situated in proximity with the printed material, or workpiece, which impart radiative and convective heat to the printed material between successive printing operations sufficient to cure the print thereon. Since only a thin layer of ink is applied in silk screening applications, the required heat exposure time for curing is relatively short. Overheating of the printed work may result in wrinkles, discoloration, shrinkage, and/or scorching of both the applied ink and the underlying material. Therefore, it is important that the heat application be closely controlled.

Normally, only a thin layer of ink is applied in screen printing operations, and exposure to ambient air is sufficient to adequately cure or dry the applied ink. However, certain applications require a heavier layer of applied ink. For instance, before printing fluorescent ink upon a black material such as a T-shirt, it is necessary to apply a heavy layer of white ink to completely cover up the black substrate. Thus, curing is generally necessary immediately following such a white layer print unit at which the heavy layer of white ink is applied.

Ink may be cured at any number of different stations between different printing operations for various reasons. Therefore, it is desirable to provide a curing apparatus which is portable so that the apparatus can be inserted and removed at any desired printing station or open station about the screen press as desired to suit a given application. Thus, one or two portable curing apparatus may be located about the press as desired to suit a given application to perform the desired curing operations, instead of maintaining a multiplicity of stationary curing apparatus about the press and only employing one or two of these in any given application. Significant savings are realized by the ability to reduce the number of curing apparatus required. Therefore, there is a need for a portable curing apparatus for use with silk screen printing presses.

The heat generated by electrical resistance heaters increases with time upon application of a given voltage, so that the heating elements require time to reach their point of maximum heat emission. A particular problem with current designs is that they are not able to reconcile the conflicting goals of providing maximum heating during curing and interruption of heat to the printed material between curing operations, without significantly reducing production speed. Two alternative methods are employed in current curing apparatus. Either the heating elements are maintained at a constant high heating level so that no time is lost in bringing the heating elements back up to their maximum level, or else the voltage supplied to the heating elements is completely interrupted between curing operations and reapplied during curing. Both designs have been found to be inadequate. Maintaining the heating elements at high voltage has been found to cause high heat build-up, and if the apparatus is stopped from indexing the workpiece, a paper or textile workpiece can be subjected to sufficient heat to scorch or to catch fire. To prevent scorching or burning of the material when the indexing movement is stopped, the voltage may be interrupted. However, interruption of the voltage to the heating elements between curing operations is undesirable in that production speeds are limited by the time required for the heating elements to reattain their maximum heating level upon reapplication of electrical power thereto.

An example of apparatus wherein the heating elements are maintained at a constant heating level is the current shutter concept. This design employs a conventional shutter system positioned between the printed material and the heating elements to isolate the heating elements from the printed material at the completion of the desired curing time. Therein, a plurality of slats pivot simultaneously between an open position, wherein the slats are parallel one another so as to allow a generally free flow of heat and air therethrough, and a closed position, wherein the slats overlap one another to block the flow of heat therethrough. Only during production interruptions is the flow of electrical power to the heating elements interrupted.

As with other portable curing apparatus employing heating elements maintained at the high curing temperature, this design has been found to be undesirable in several respects. Since the function of the shutters is to block off the open face of the housing between curing operations to prevent heat from exiting therefrom, an undesirable accumulation of heat within the housing develops. This results in the overall apparatus, including the shutters, becoming hot. Thus, during production interruptions, wherein power to the heating elements is interrupted, the heated apparatus continues to impart undesirable heating to a printed material situated therebeneath. There is a need to prevent this residual heating.

Also, the aforementioned accumulation of heat, in combination with the high temperature produced by the heating elements, has been found to cause warping of the shutters. Such warping results in the inability of the shutters to effect an adequate seal between the heating elements and the workpiece, thereby allowing radiative and convective heat to be imparted to the printed material between curing operations. Warping of the shutters has also been found to cause malfunctions in the opening and closing thereof. Furthermore, the high temperature of the heating elements and heat accumulation has been found to cause excessive metal fatigue in nearly all movable components of the apparatus, which further contributes to an undue number of shutter malfunctions. Accordingly, it is desirable to provide a portable curing apparatus in which the heating elements are not maintained at a continual high temperature.

Likewise, curing apparatus in which the electrical supply to the heating elements is completely interrupted between curing operations have been found undesirable as well. While the heat accumulation problems associated with constant heating of the heating elements is minimized, the problem with such designs is that their production capacity is relatively slow. That is, since the heating elements require time to reattain the desired heating level for curing after each power interruption, the production rate is limited by this lag time. Since advances in press speeds are constantly being realized, it is desirable to provide a curing apparatus which does not require significant time to reheat the heating elements between each curing operation. For example, T-shirt screen printers may index the pallet holding the T-shirt every four to six seconds. Stopping of the indexes for 20 or 30 seconds to reattain the desired heating level will slow production.

Of additional importance in such apparatus is the ability to completely interrupt the application of heat to the printed material after the desired curing period. Current curing apparatus, and most particularly portable curing apparatus due to their minimized machinery, suffer in their inability to prevent residual heat from the apparatus from continuing to heat the printed material even after complete discontinuation of electrical flow to the heating elements. That is, the electrical resistance heating elements become heated to very high temperatures and require time to cool down, even after interruption of electrical power. Also, the electrical resistance heating elements employed to impart the desired heat for curing, heat not only the printed material, but also heat the apparatus supporting and housing the heating elements. After the desired curing time has elapsed, and the flow of electricity to the heating elements is interrupted, it is important to prevent the heated curing apparatus and heating elements from continuing to impart heat to the workpiece. Otherwise, accurate curing times are not attainable and overheating may result.

While it is possible to compensate, at least in part, for such residual heating wherein the apparatus is in continuous operation with printed materials regularly advanced, such residual heating is particularly problematical wherein it is necessary to interrupt production for any reason, thereby leaving printed material stationary beneath the curing apparatus. Generally, the length of such interruptions is unknown, and during such interruptions a printed material may be situated in proximity with the heated curing apparatus which will continue to impart convective heat to the printed material throughout the duration of the interruption. This uncontrolled residual heating precludes the aforementioned requisite heating accuracy.

Therefore, there is a need for a curing apparatus capable of imparting an accurately controlled amount of heat to a printed material, and thereafter preventing any residual heat of the apparatus from effecting the printed material. It is desirable to provide such an apparatus which does not employ mechanical means in proximity with the heating elements so that fatigue effects are minimized. Also, since curing apparatus are not necessary for many applications, it is desirable to provide such an apparatus which is portable, so that the apparatus can be relocated to any position about the printing press, or removed completely from the press, as required to suit a desired operation. It is also desirable to provide such apparatus wherein the height of the heating elements in relation to the printed material can be accurately and easily adjusted so as to provide flexibility to allow the apparatus to be utilized in conjunction with a wide variety of printing presses, and also allow for more accurate control of the amount of heat from the heating elements imparted to the printed material. Furthermore, it is desirable to provide such a curing apparatus which lends itself to economical manufacturing and operation.

In addition to the above criteria, the curing apparatus should be versatile so that a single curing apparatus can accommodate different garment sizes and different print sizes, shapes and positioning without consuming unnecessary electrical power. In particular, electrical resistance heating apparatus utilize a great deal of electrical energy in their operation, which energy consumption is quite costly. Thus, it is desirable to minimize the amount of energy consumed.

SUMMARY OF THE INVENTION

In accordance with the present invention, there is provided a portable curing apparatus for use with a wide variety of screen printing presses, which provides medium wavelength infrared electrical resistance heating to a printed material or workpiece sufficient to rapidly cure the ink printed thereon while preventing residual heat from the apparatus from continuing to heat the printed material after the completion of the desired curing time. This provides the requisite accuracy in control of the time over which heat is imparted to the printed material for curing of printed material thereon prior to the workpiece undergoing a subsequent printing operation. Apparatus constructed in accordance with the present invention are particularly advantageous in situations wherein production is interrupted. The apparatus provides means for preventing any residual heat of the apparatus from continuing to heat the workpiece between curing operations. Furthermore, since no mechanical components are employed in proximity with the heating elements, apparatus constructed in accordance with the present invention have increased longevity and reduced repair necessity.

In accordance with one embodiment of the present invention, during the intervals between curing operations, the voltage supplied to the heating elements is dropped to a fraction of the curing voltage, and a thin layer of high velocity air is simultaneously blown between the heating elements and the workpiece. The airflow rate is sufficient to dissipate the low heat generated by the heating elements at the reduced voltage, and any residual heat from the heating elements and their housing, away from the workpiece. The airflow also increases convection at the workpiece surface, which further assists in the cooling thereof between curing operations.

That is, while a predetermined full voltage sufficient to effect curing is supplied to the heating elements during curing, the voltage is reduced to approximately one half to one quarter of full voltage between curing operations and during production interruptions and, during such periods of low voltage, air is blown between the apparatus and printed material. Upon a subsequent registration of a printed material beneath the curing apparatus, full voltage is resumed and the airflow discontinued.

The supplied voltage is alternated between high and low levels, and the blower twined on and off, based upon signals sent from a programmable control panel. The control panel is interconnected with each of several outlets with an outlet located at each printhead on the press, into which the curing apparatus are plugged.

Quartz tubes or similar electrical resistance heating elements are employed which allow operation under both partial and full voltages with the heat generated by the tubes proportional to the applied voltage. Both between curing operations and during periods of production interruption, a reduced voltage continues to be supplied to the heating elements. This allows the heating elements to reattain their maximum heating level more rapidly upon reimposition of full voltage than designs wherein the voltage to the heating elements is completely interrupted between curing operations. Accordingly, a greater number of materials can be cured in a given time by apparatus constructed in accordance with the present invention. Also, the voltage reduction attributes to a reduction in energy consumption.

Further minimization of energy consumption is realized by the provision of means for independently energizing selective zones of the apparatus. For instance, an operator can set the curing apparatus to energize only those heating elements at the central portion of the apparatus for applications in which the print to be cured is small and confined to the central portion of the garment. For larger prints, the operator can selectively energize a second zone of infrared heating elements outward of the central zone, in addition to energizing the central zone heating elements, to create a larger overall curing area.

More specifically, in T-shirt applications there has been a trend toward printing on an entire side of a T-shirt, with a corresponding need to cure an entire side of a T-shirt. Hence, in one embodiment of the invention, a series of heat curing elements are arranged in a T-shape, corresponding to the shape of a large T-shirt. To optimize use of electrical power, the curing apparatus includes a control panel which is programmable to supply electric power only to those heating elements beneath which the print extends, and interrupt the supply of electrical power to those heating elements not having print therebeneath. For instance, in one application the print may be formed only at the center of the chest of the shirt in which case the curing apparatus would be programmed such that only the central portion of heating elements may be energized. In another application the print may extend out wider, in which case both the central portion of heating elements, together with those heating elements immediately outward therefrom, are energized to provide curing over a larger area. In a third application wherein curing is required over still a larger area, further heating elements, outward of the second portion of heating elements, would then be energized to provide curing over a still larger area. The selective independent control of different portions of heating elements allows the overall energy usage to be minimized by allowing those heating elements outward of the required curing area to be energized only when the print to be cured extends therebeneath, and to otherwise be left idle.

The aforementioned heat accumulation problems associated with a continual electrical supply to the heating elements are eliminated in apparatus constructed according to the present invention. Since the entire face of the heating elements are exposed to ambient air with a stream of forced air passing thereover, the low level heat generated by the heating elements between curing operations and during production interruptions is dissipated away from the workpiece sufficiently to prevent the workpiece from being heated any significant amount.

The heating elements and blower are removably mounted on a caster supported stand which allows the apparatus to be wheeled into any desired position at which curing is required, and wheeled out of position as desired to suit a given application. The tube bed housing the heating elements, and the blower, may be made removable from the support stand, thereby allowing the panel to be placed in an accommodating screen printing frame provided on a press with the blower, free standing on the floor, in communication therewith. Thus, the support stand can then be wheeled away from the press, thereby allowing greater operator room for maneuvering about the press and also making any necessary repairs thereto.

A further advantage of apparatus constructed in accordance with the present invention is the elimination of mechanical elements. By employing a stream of air instead of shutters, the aforementioned problems associated with warping are eliminated. Also, since there are no movable parts in proximity to the heating elements, fatigue is not a critical factor in the efficiency of operation of the apparatus, as was the case with previous designs.

While large, stationary curing devices can employ complex cooling arrangements, portable units are limited in the machinery they support by the need to maintain mobility. Apparatus constructed in accordance with the present invention, provide the requisite heating interruption in a portable unit. Thus, apparatus constructed in accordance with the present invention lend themselves to more simple and economical fabrication than previous curing apparatus.

This invention will be more fully understood and further objects and advantages thereof will become apparent in the following detailed description of preferred embodiments of the invention illustrated in the accompanying drawings.

BRIEF DESCRIPTION OF THE DRAWINGS

Wherein like elements are referenced alike:

FIG. 2 is an enlarged, cross sectional view of the upper portion of the embodiment of FIG. 1;

FIG. 3 is an enlarged, fragmentary view of the plenum portion of the view of FIG. 2, particularly illustrating the path of airflow;

FIG. 4 is an enlarged top view of the embodiment of FIG. 1;

FIG. 6 is a perspective view of an alternative embodiment of a curing apparatus embodying various features of the present invention;

FIG. 7 is an enlarged fragmentary view of the control switches of the curing apparatus of FIG. 6;

DETAILED DESCRIPTION OF THE PREFERRED EMBODIMENTS

Figure 1:
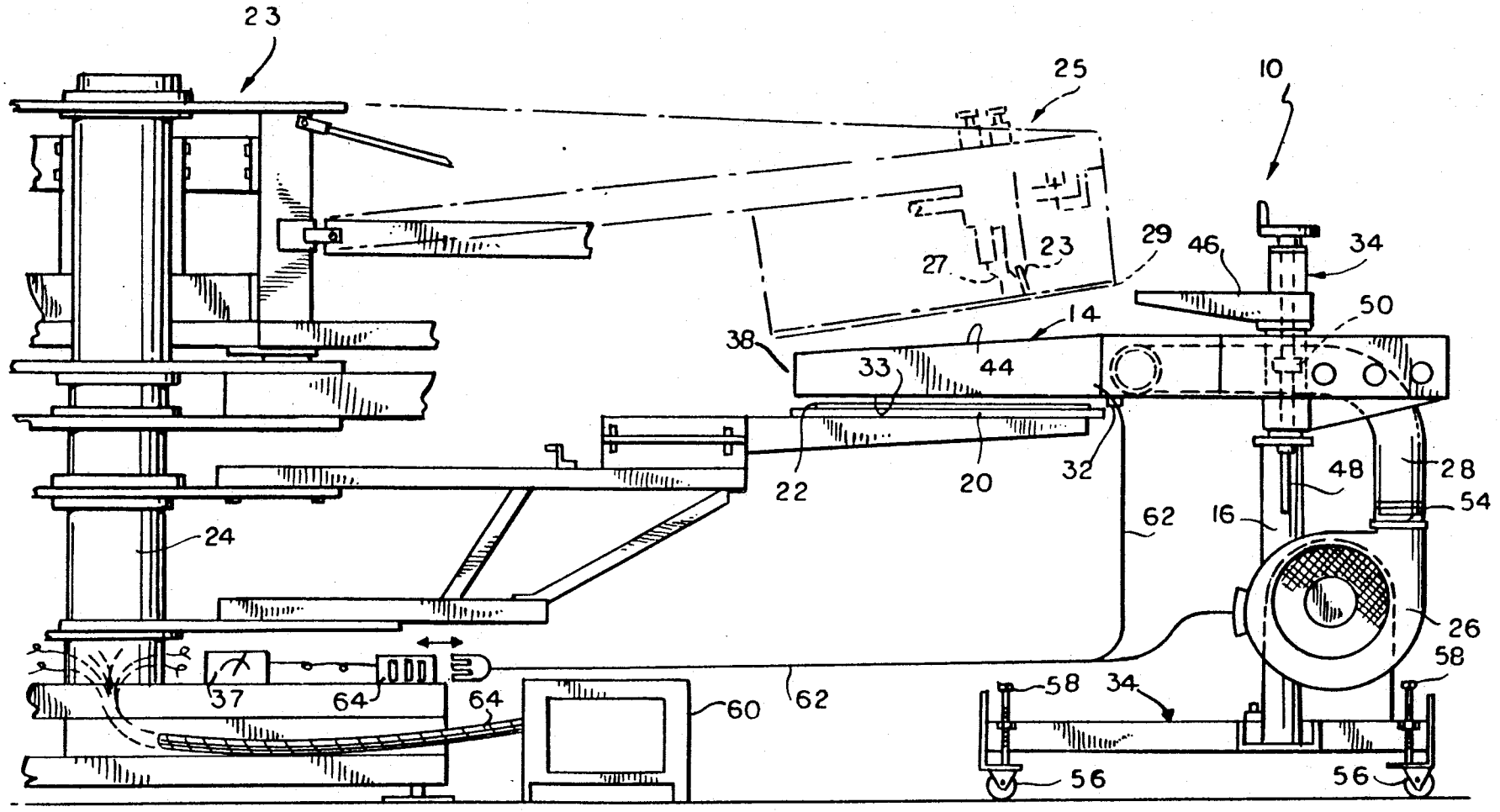
FIG. 1 is an illustration of an embodiment of a curing apparatus constructed in accordance with the present invention, shown positioned above a printed material which is carried upon rotary platens.
Figure 5:
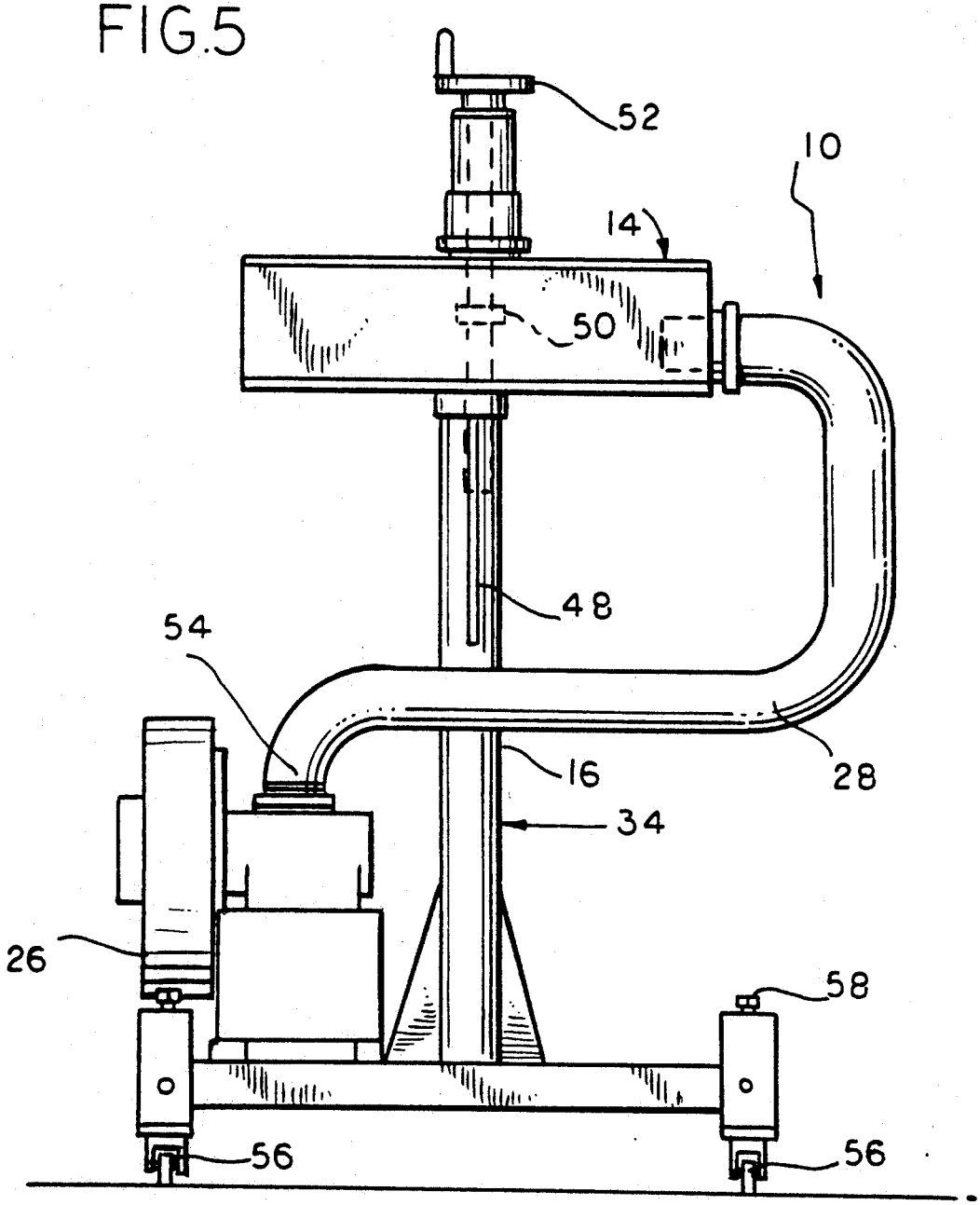
FIG. 5 is an enlarged rear view of the embodiment of FIG. 1.

FIGS. 1-5 show preferred embodiments of a curing apparatus constructed according to principles of the present invention. The overall apparatus is designated generally at 10. As best seen in FIG. 2, a plurality of quartz tubes 12, which are electrical resistance heating elements, are supported by a generally horizontal arm 14 which is, in turn, supported upon a vertical column 16. The plurality of quartz tubes 12 are located in a tube bed 18 which is removably attached to the horizontal arm 14 at a point distant from the vertical column 16. The arm 14 and tubes 12 are spaced above a platen 20 and workpiece or material 22 which pass below the tubes. The arm 14 is cantilevered over the platen and this allows the rotary platens 20, upon which material 22 to be printed is conventionally mounted, to sequentially pass beneath the tube bed 18 without contacting the vertical column 16. (see FIG. 1)

In conventional screen presses 23, a plurality of platens 20 rotate about a central column 24 and sequentially carry the material 22 mounted thereon into registration with printing heads 25 including a squeegee 23 and flood bar 27, the printing heads being located peripherally about the central column 24. The tube bed 18 portion of the apparatus 10 is positioned so as to also be in registration with one of the platens 20 when the platens are at rest and the printing heads 25 are positioned to print at the other stations where no curing apparatus is present. Thus, the apparatus 10 cures the material 22 after it has been printed upon at a preceding station and is rotated into registration at an open, non-printing station at which is located the tube bed 18 portion of the apparatus. That is, while the several materials in registration with their respective printing units are undergoing printing operations, the printed material in registration with the curing apparatus 10 is simultaneously undergoing curing.

Curing is attained by supplying electric power to the quarts tube heating elements 12 while the printed material is situated therebeneath, which causes the tubes to become hot and impart heat to the printed material 22 to effect curing. The maximum temperature which the quartz tubes 12 will reach varies in proportion to the voltage supplied thereto. The voltage applied to the tubes 12 is variable, and the optimal voltage to be supplied will vary depending upon the specific application. In most applications, however, the voltage supplied during curing is the maximum possible for the type of quartz tube 12 employed. This results in the greatest possible heating during curing, which therefore provides the most rapid curing time attainable. Thus, after a material 22 has been printed upon, and advanced to a position beneath the extending tube bed 18, a predetermined electrical power is supplied to the tubes 12 for a period sufficient to effect curing of the printed material. This cure time will vary dependent upon the heating capability of the quartz tubes 12 employed, the selected voltage, the materials being cured and other parameters particular to the application at hand.

However, in certain situations, it is not desirable to provide the maximum possible heating during curing. In such situations wherein a curing voltage less than the maximum possible voltage is to be employed during curing operations, such as for heat sensitive materials, full voltage is supplied to the heating elements 12 until the desired heating level is attained and thereafter the voltage is lowered to the desired reduced heating level. Normally, this reduced curing level is only slightly less than the maximum level. The heating elements 12 heat up more quickly with higher voltages than with lower voltages. After the heating elements 12 have been at low voltage between curings and during production interruptions, it is desired to bring the heating elements up to the desired higher heating level for curing as quickly as possible. By supplying a higher voltage to the heating elements 12 initially, until the desired heating level is attained, the heating elements can be brought to the desired heating level for curing more quickly than designs in which less than the maximum voltage is supplied initially.

At the completion of the desired curing time, the voltage supplied to the quartz tubes 12 is reduced to a fraction of the full voltage. The reduced voltage is generally between about one quarter to one half of the maximum voltage, although reduced voltages outside this range may be desirable for certain applications.

Simultaneous with the voltage drop to the tubes 12, the blower 26 is actuated to induce a flow of air between the tube bed 18 and the printed material 22. Conduit 28 extends from the blower 26 to the plenum portion 30 of the horizontal arm 14. A slotted opening 32 is provided in the plenum portion 30 through which the air from the blower 28 can exit the plenum 30 as a thin sheet of high velocity airflow. The slot 32 is configured so as to direct the airflow generally along the underside 33 of the tube bed 18, whereby the air passes between the apparatus 10 and the printed material 22, generally parallel to the underside 33 of the tube bed 18. With the quartz tubes 12 at a reduced voltage, and, therefore, a reduced heating level, the sheet of high velocity air passing between the tube bed 18 and the printed material 22 is sufficient to prevent significant further heat transfer to the printed material. Accordingly, between successive curing operations, and during periods of production interruption, the aforementioned problems associated with continued heating of the printed material 22 during these periods is eliminated, regardless of the duration of such periods. Also, since the voltage supplied to the quartz tubes 12 is not entirely cut off between successive curing operations, less time is required to bring the quartz tubes 12 back to their maximum heat level upon reapplication of full voltage thereto. This allows complete curing of successive printed materials 22 at a faster rate than previous designs.

In accordance with one embodiment of the present invention, the tube bed 18 and blower 26 are mounted on a caster supported portable stand 34. This allows the apparatus 10 to be wheeled to any desired location about a screen press 23 as desired to suit a given application. Normally, the curing apparatus 10 will be placed at a location formerly occupied by a printing head, which head has been lifted out of position (see phantom lines in FIG. 1). Thus, after a printing head 25, including the squeegee 23, flood bar 27 and silk screen, is lifted upwards, the tube bed portion 18 of the apparatus 10 is inserted underneath the printing head 25. Thus, as the platens 20 come to rest with the plurality of printing heads printing upon the respective materials 22 therebeneath, one of the platens 20 supporting printed material 22 will be beneath the cantilevered tube bed 18. Accordingly, while the printing heads are printing upon the material thereat, the curing apparatus 10 cures the printed material thereat.

In the majority of screen printing applications, it is sufficient for the ink to be applied thinly. With such a thin layer of ink, drying thereof is attainable merely by exposure to ambient air for a short time. However, for heavier paint applications, a separate curing apparatus is required to dry the printed material prior to a subsequent printing thereupon. Normally, the printing head is removed, and the curing apparatus 10 inserted, at the printing station immediately following a station at which the heavy layer of ink is applied. One example of where heavier ink applications are required is the application of white ink upon a black material prior to applications of fluorescent ink at subsequent printing stations. A heavy layer of ink is required in such applications to completely cover the substrate. Accordingly, the following station to which the printed material 22 is subsequently transported will have a curing apparatus 10 inserted thereat to cure the printed material prior to its being moved to a subsequent station at which it will undergo an additional printing operation.

The tube bed 18 comprises an outer housing 36 which supports a plurality of generally parallel quartz tubes 12 at their ends. Electrical power supplied to the tubes 12 causes the tubes to become heated, with the amount of heat generation proportional to the voltage supplied.

Actuation of the quartz tubes 12 and blower 26 is controlled by a control panel 60 of the type well known in the art which can alternatively supply a selected high voltage and a selected lower voltage to the tubes. These voltages are variable by adjustment of the control panel. Also, the control panel 60 is programmable so that, for instance, a very high voltage can be supplied to the quartz tubes 12 initially to rapidly heat the tubes with a slightly reduced voltage supplied after attainment of the desired curing temperature.

The control panel 60 is operated by electrical signals from the press which are sent to the control panel upon rotation of the platens 20, such that the voltage to the tubes 12 is increased, and the blower 26 turned off, upon registration of each successive printed material 22 beneath the curing apparatus 10; and the voltage to the tubes 12 decreased, and the blower 26 turned on, at the completion of a predetermined curing time. A safety time limit switch 37 is employed to return the apparatus 10 to its low voltage mode after the apparatus has been in its high voltage mode for a predetermined maximum time without receipt of a signal from the press 23 to the control panel 60. The time limit switch 37 may be mounted on the press 23, as shown in FIG. 1, or incorporated into the control panel. Thus, during periods of production interruption, the platens 20 are stationary, so no control signals are sent from the press 23 to the control panel, and the apparatus 10 continues to dwell in low voltage mode, with the blower 26 turned on, until production is resumed. Upon resumption of production, a signal is sent by the press to the control panel 60 upon registration of the platens 20 to return the apparatus to its high voltage mode. Electrical power from the control panel is supplied to the quartz tubes 12 and blower 26 through conventional wiring 62 extending therebetween. The control panel 60 is connectable to each of a plurality of outlets 64, each located at a respective printing head. This allows the apparatus to be simply plugged into the desired outlet 64 at which the apparatus is positioned and be controlled by the control panel 60 as programmed. This eliminates the need for extensive wiring from the wall to each apparatus. The ability to program the control panel 60 allows for automatic actuation of the various curing apparatus constructed in accordance with the present invention regardless of how many units are connected and regardless of the position at which they are located.

As seen in FIG. 2, the tube bed 18 is removably mounted near the free end 38 of the cantilevered horizontal arm 14, and it extends out over the platens 20 rotating therebeneath. Removability of the tube bed 18 is desirable to allow for replacement of individual quartz tubes 12 therein, or replacement of the entire tube bed 18 as a whole, as may be required due to the continual thermal cycling which the tubes must undergo. This thermal cycling also causes repeated expansion of the air surrounding the tube bed 18. The underside of the horizontal arm 14 is provided with an opening which extends from the free end 38 of the horizontal arm 14 to the plenum portion 30, and across the width of the tube bed 18 as well. This opening allows unimpeded heat flow from the underside 33 of the tube bed 18 to the printed material 22. To prevent pressure build-up associated with the aforementioned air expansion and heat accumulation in the region above the tube bed 18, vents 42 may be provided in the upper surface 44 of the horizontal arm 14 to allow ventilation therethrough.

As discussed previously, the blower 26 is turned on simultaneous with a reduction in the voltage supplied to the quartz tubes 12 during periods in which no curing is desired, such as between successive curing operations and during production interruptions. During such periods, the voltage supplied to the quartz tubes 12 is reduced so that only low level heat is generated therefrom. The forced air from the blower 26 is passed between the apparatus 10 and the printed material 22 to prevent the low level heat which continues to be generated by the quartz tubes 12 from affecting the printed material.

Conduit 28 extends from the outlet 54 of the blower 26 into the plenum portion 30 of the horizontal arm 14. As best seen in FIG. 3, the plenum 30 is provided with an elongated slotted opening 32 through which the pressurized air in the plenum 30 exits therefrom as a thin sheet of high velocity air. The slotted opening 32 is configured so as to direct the sheet of high velocity air between the tube bed 18 and the printed material. Various configurations of slotted openings 32 are suitable to achieve this.

As stated above, the desired voltage to be supplied to the quartz tubes 12 will vary depending upon the specific heat required to attain curing in a given application. Further flexibility in control over the amount of heat imparted to the printed material 22 is attainable by varying the distance between the tube bed 18 and the printed material 22. Accordingly, the horizontal arm 14 on which the tube bed 18 is supported is provided with means for adjusting the height thereof. In addition to allowing variation of the distance between the tube bed 18 and printed material 22, the height adjustment capability also allows the apparatus 10 to be used in conjunction with a wide variety of screen presses 23 having differing platen heights.

To allow for adjustments in the height of the tube bed 18, the horizontal arm 14 is provided with an aperture therein through which the vertical column 16 extends to support the horizontal arm 14 thereupon in a cantilevered fashion. The horizontal arm 14 can thus move up and down the vertical column 16 to the desired height. Since the apparatus 10 may become heated, a handle 46 is provided by which an operator can simply grip the handle 46 to position the tube bed 18 to the desired position above the platens 20. After the apparatus 10 has been placed into position, the height of the tube bed 18 in relation to the printed material 22 situated therebeneath can be adjusted. A threaded pin 48 extends into a complementary threaded nut 50 which is affixed to the horizontal arm 14, so that adjustments in the height of the horizontal arm 14 are thereby attainable by rotation of the threaded pin 48. A pin handle 52 is provided atop the threaded pin 48 to allow for easier rotation of the threaded pin 48 by an operator without the use of additional tools. Thus, the horizontal arm 14, and, therefore, the tube bed is maintained at a desired height and accurately adjusted by interaction of the threaded pin 48 within the nut 50.

The support stand 34 is mounted upon retractable casters 56 to allow for easy repositioning of the apparatus 10. After the apparatus 10 has been moved into the desired position about the press 23, the casters 56 are retracted upward, until they are higher than the adjustable legs 58. The casters 56 may be interconnected by a wormgear arrangement or other suitable arrangement so that all the casters are elevated simultaneously by the turning of a single handle. With the casters 56 elevated higher than the legs 58, the stand 34 will then be supported upon the four adjustable legs 58 rather than the casters 56. This prevents the apparatus 10 from moving about during production. The four legs 58 are independently adjustable to allow for leveling of the tube bed 18 portion of the apparatus 10 regardless of the unevenness of the plant floor on which the stand 34 rests.

The support stand 34 may also be provided with a registration pin or similar component which is received into a complementary registration component on the press to provide quick, accurate positioning of the apparatus.

An alternative embodiment of a curing apparatus embodying various features of the present invention is illustrated in FIGS. 6-10 and referred to generally at 110. The overall construction is generally the same as that of the embodiment discussed above, with the curing apparatus 110 having a plurality of heating elements 112 supported by a horizontal arm 114 which is mounted on a support stand 134 for ready transport to any desired position about the periphery of a press. In this embodiment of the curing apparatus 110, power is supplied to selective regions of the heating elements 112 at a high curing voltage for a predetermined period of time following receipt of an electrical signal indicating the registration of a workpiece beneath the heating elements, and the power to the selective region of heating elements is reduced to a lower level after passage of the predetermined period to prevent overheating. Upon receipt of a subsequent electrical signal indicating a subsequent workpiece registration, full curing power is again supplied to the heating elements 112 to effect curing. This is in contrast with the aforementioned embodiment discussed above, in which all of the heating elements, rather than just a selective group, are electrically cycled together. As with the above embodiment, an air blower 126 blows air between the heating elements 112 and the workpiece 122 during the intervals between successive curing operations, during which period the voltage to the heating elements is also reduced, as discussed in detail above with respect to the embodiment of FIGS. 1-5.

The principal distinction between this embodiment of the invention and the embodiment described in detail above is in the arrangement and control of the heating elements 112. A particular feature of the preferred embodiment is that different regions of heating elements 112 can be selectively energized independent of other regions of heating elements. This allows only those heating elements 112 situated directly above the printed ink to be energized, while the remaining heating elements are not energized. This is in contrast with current infrared curing apparatus in which all of the heating elements are energized and de-energized as a whole. Accordingly, significant energy savings are realized by the provision of a curing apparatus which allows for simple and rapid programming to suit the requirements of each particular run to eliminate energization of those heating elements 112 not directly above the printed image.

Figure 9:
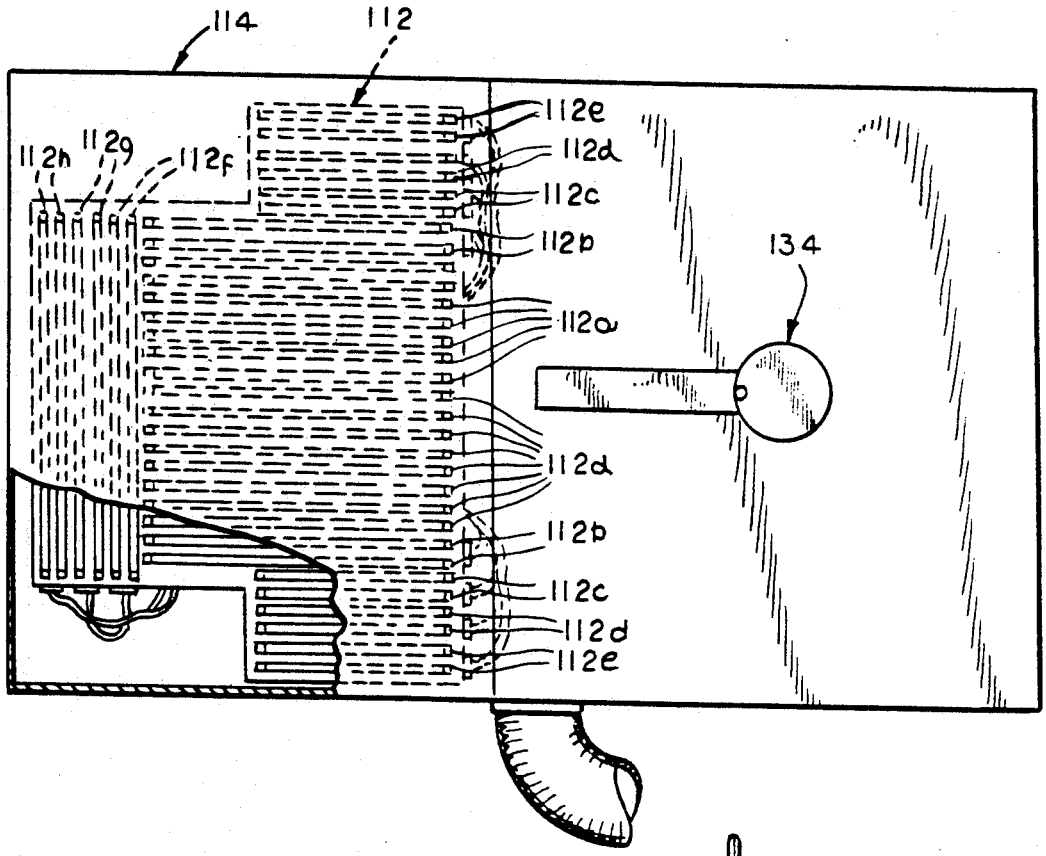
FIG. 9 is a plan view of the curing apparatus of FIG. 6 showing the arrangement of the heating elements.
Figure 10:
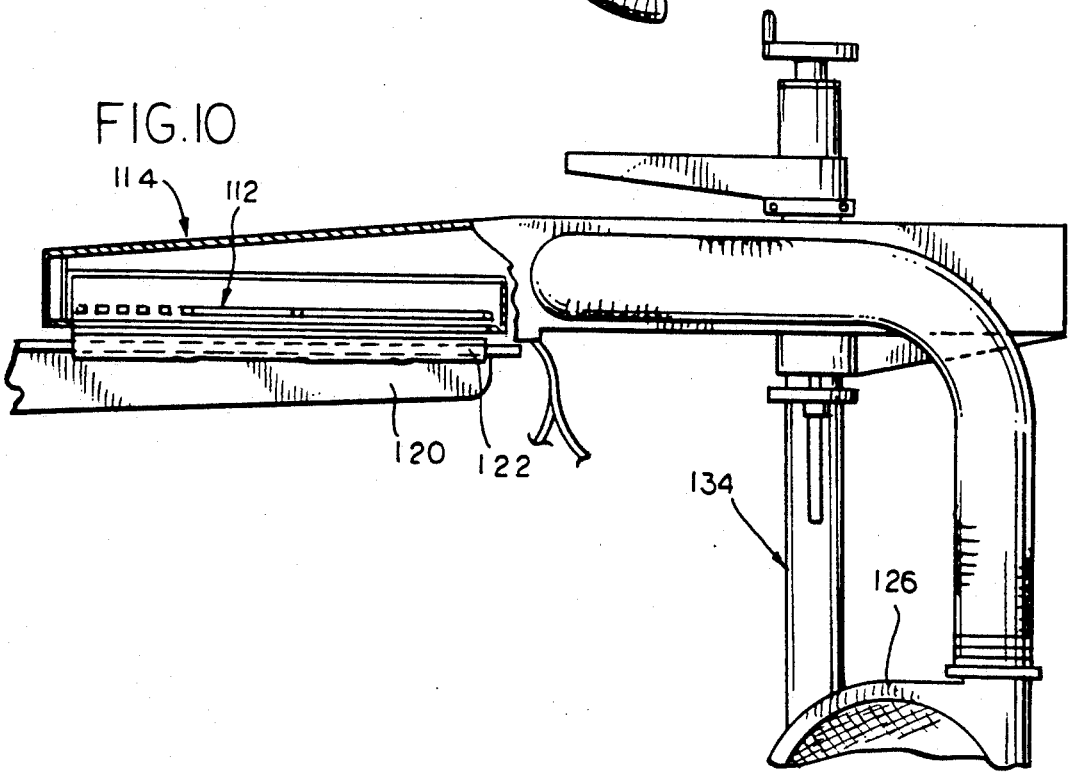
FIG. 10 is a side elevational view of the curing apparatus of FIG. 6 shown with the heating elements positioned out over a platen.
Figure 11:
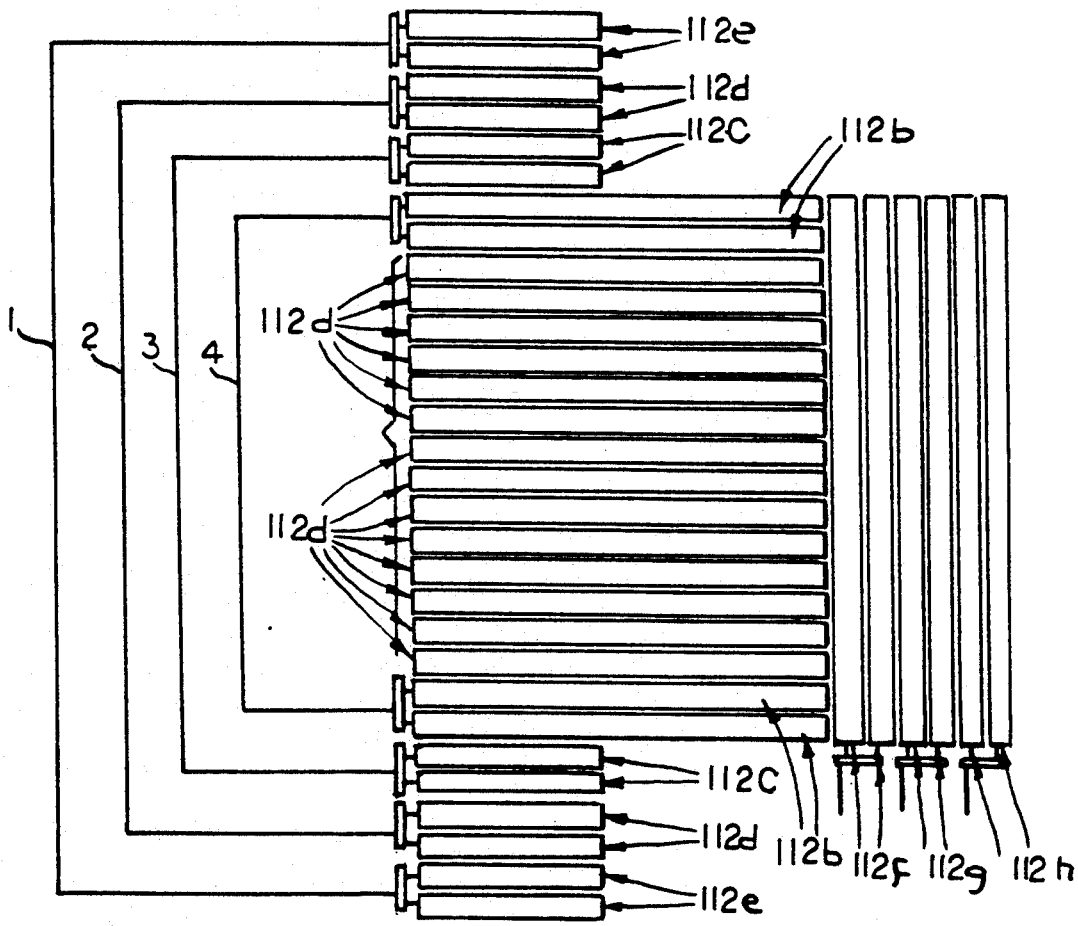
FIG. 11 is a schematic plan view of the heating elements of the curing apparatus of FIG. 6.

As seen in FIG. 9 and as best seen in FIG. 11, the plurality of heating elements 112 are arranged in a T-shape, to correspond to the shape of T-shirts which are to be cured by the apparatus, although it is readily appreciated that other configurations particularly well suited for other specific garments may just as easily be employed in carrying out the invention. The arrangement of heating elements 112 comprises a central chest region of heating elements indicated at 112*a*. A pair of chest region enlarging heating elements 112*b* are positioned on opposite lateral sides of the central chest region 112*a*. The chest region enlarging heating elements 112*b* are interconnected so that they are energized and de-energized simultaneous with one another.

Pairs of shorter sleeve heating elements 112*c*, 112*d* and 112*e* are positioned on opposite sides of, and extend laterally outward of, the chest region enlarging heating elements 112*b* at a location corresponding to the T-shirt sleeves. Also, a series of waist heating elements 112*f*, 112*g* and 112*h* extend outward from the lower side 114 of the central region the T-shirt waist. Any or all of these regions can be selectively energized in any given run, depending upon the size, shape and location of the printed image to be cured. Whichever heating element regions are selected, the power supply to those heating elements will cycle simultaneously with the power supply to the central chest region of heating elements 112*a*, with the electrical power supplied to the selected heating elements being reduced and maximized together with the central chest region 112*a* upon advancement of the pallets 120 as described above with respect to the first embodiment.

By way of example, T-shirts which are printed upon only at the center of the chest portion thereof will require energization of only the central region 112*a* of heating elements to effect curing of the printed image, with no electrical power supplied to the remaining heating elements since there is no ink to be cured thereat. In a subsequent run of T-shirts having print extending across both the center of the chest portion and the sleeves, the curing apparatus is readily programmable to cause the sleeve heating elements 112*b*, 112*c* and 112*d* to be energized together with the central region 112*a* to effect curing of the entire printed image, with the waist heating elements 112*f*, 112*g* and 112*h* remaining idle since there is no print thereat. Finally, in a run of T-shirts having printing across an entire side of the shirt, all of the heating elements are energized, with none remaining idle.

With reference to an illustrative embodiment constructed in accordance with the configuration illustrated in FIG. 11, in which each of the sleeve region heating elements 112*c*, 112*d* and 112*e* consumes 700 watts of power, each of the waist region heating elements 112*f*, 112*g* and 112*h* consumes 1,400 watts of power, and each of the central region heating elements 112*a* consumes 1,200 watts of power, the aforementioned electrical power savings afforded by the present invention will now be pointed out with particularity. Energization of all of the heating elements consumes 38,400 watts of power. By eliminating energization of all the sleeve panels 112*c*, 112*d* and 112*e* in those runs wherein there is no print on the shirt sleeves, the power consumption drops to 30,000 watts, and a power reduction of 8,400 watts is realized, resulting in a power savings of 21%. In those applications in which only the central region of heating elements 112*a* are required to be energized to effect proper curing, with no print extending onto the shirt sleeves or the waist, only 21,600 watts of power are consumed, and a power reduction of 16,800 watts is realized, resulting in a 43% power savings over prior art curing apparatus in which the entire bed of heating elements are energized as a single unit. It should now be readily apparent that the significant power reduction afforded by the curing apparatus of the present invention translates into significantly reduced production costs. In the crowded, competitive field of screen printing, such reductions in the production cost are extremely significant.

The curing apparatus of the present invention allows very simple and rapid changeover from energization of a first set of heating element regions to energization of a different set of heating element regions. This eliminates the requirement of having to remove a first curing apparatus having a given heating element configuration and replacing it with a completely separate curing apparatus having a different heating element configuration each time there is a changeover of print patterns. This minimizes downtime associated with changeovers, thereby further reducing production costs.

Returning now to the detailed description of the construction of the preferred embodiment of the curing apparatus 110, the central region of heating elements 112*a* and chest region enlarging heating elements 112*b* all extend longitudinally, parallel to one another, and are of generally equal length. The sleeve region heating elements 112*c*, 112*d* and 112*e* also extend longitudinally, parallel to one another and parallel to the central region heating elements 112*a*. The sleeve region heating elements 112*c*, 112*d* and 112*e* are shorter heating elements since they only need to extend across the width of the shirt sleeves. The waist region heating elements 112*f*, 112*g* and 112*h* extend parallel to one another and transverse to the central region heating elements 112*a* and sleeve region heating elements 112*c*, 112*d* and 112*e*. The overall configuration of all of the hating elements 112*a*–112*h* defines a T-shape as best seen in FIG. 11. This T-shape is made proportional to the size of the T-shirts which are to be cured by the apparatus 110.

The central region of heating elements 112*a* are all interconnected so that they are energized and de-energized as a single unit. For small prints confined to the central chest portion of the T-shirt, only this region of heating elements 112*a* is energized to effect curing, with all of the remaining regions of heating elements 112*b*, 112*c*, 112*d*, 112*e*, 112*f*, 112*g* and 112*h* remaining idle.

To effect proper curing of wider prints which extend across the entire chest of a shirt, it is necessary to energize both the central region heating elements 112*a* and the chest region enlarging heating elements 112*b*. Energizing the chest region enlarging heating elements 112*b* widens the effective curing area of the curing apparatus 110.

Figure 12:
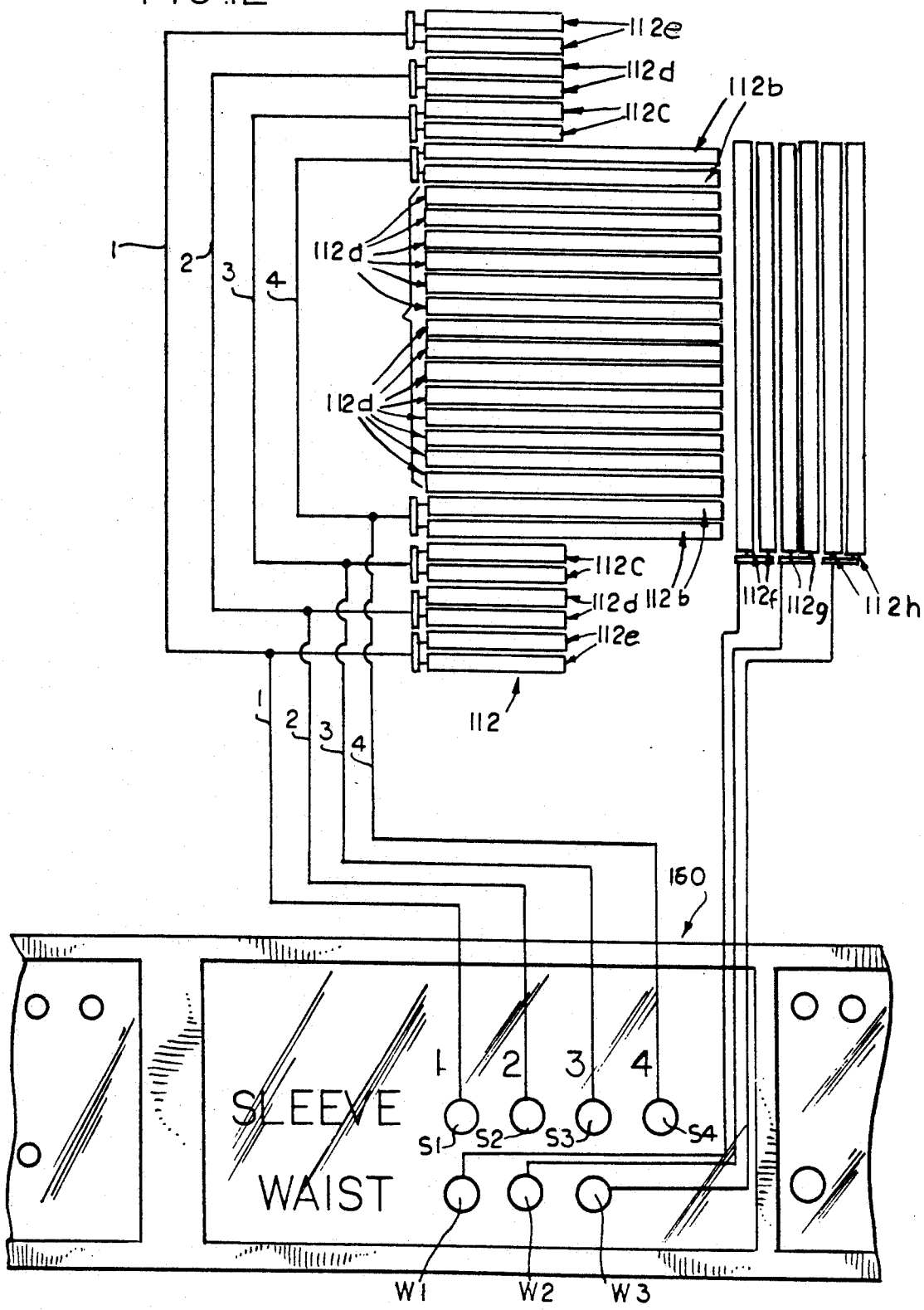
FIG. 12 is a schematic view of the interconnection between the control panel and the heating elements.

There are four chest region enlargement heating elements 112*b*, with one pair of the heating elements 112*b* situated on either side of the central region heating elements 112*a*. The two pairs of chest region enlarging heating elements 112*b* are interconnected, as indicated in FIGS. 11 and 12 by electrical control line 4, so that the effective curing area is widened equally on both sides of the central curing region 112*a*. As will be explained later, the four chest region enlarging heating elements 112*b* are easily engaged and disengaged by simply depressing a single button S4 on the control panel 160.

To cure prints which extend onto the shirt sleeves, one or more of the sleeve region heating elements 112*c*, 112*d* and 112*e* must also be energized. The inner pairs of sleeve region heating elements 112*c* are located adjacent the chest region enlarging heating elements 112*b*, on opposite sides thereof. The middle pairs of sleeve region heating elements 112*d* are positioned immediately laterally outward of the inner sleeve heating elements 112*c*, on opposite sides of the central region 112*a*. The outer pairs of sleeve region heating elements 112*e* are positioned immediately outward of the central pairs of sleeve region heating elements 112*d*, on opposite sides of the central region 112*a*.

Each of the respective dual pairs of sleeve region heating elements 112*c*, 112*d* and 112*e* which are positioned on opposite sides of the central region 112*a* are interconnected. That is, with reference to FIG. 11, the two pairs of inner sleeve region heating elements 112*c* are interconnected as indicated by electrical control line 3, so that they are activated and deactivated simultaneously; the two pairs of middle sleeve region heating elements 112*d* are interconnected as indicated by control line 2, so that they are activated and deactivated simultaneously; and the two pairs of outer sleeve region heating elements 112*e* are interconnected as indicated by control line 1, so that they are activated and deactivated simultaneously. Each of these dual pairs of heating elements 112*c*, 112*d* and 112*e* are independently actuated by depression of respective buttons S3, S2 and S1 on the control panel 160, as will be explained in greater detail below.

The waist region heating elements 112*f*, 112*g* and 112*h* are also independently selectively controllable. There are a pair of inner waist region heating elements 112*f* adjacent the ends of the central region heating elements 112*a*, a pair of middle waist region heating elements 112*g* outward thereof, and a pair of outer waist region heating elements 112*h* outward of the middle waist region heating elements 112*g*.

For curing short shirts or shirts having no print at the lower, waist region thereof, all of the waist region heating elements 112*f*, 112*g* and 112*h* are disengaged and remain inactive. For shirts having print which extends beyond the lower ends of the central region heating elements 112*a*, waist region heating elements 112*f*, 112*g* and 112*h* may be selectively energized. Depending upon how far down the print extends, one or more of the waist heating elements 112*f*, 112*g* and 112*h* will be energized. As with all of the sleeve region heating elements 112*c*, 112*d* and 112*e*, the waist region heating elements 112*f*, 112*g* and 112*h* are each independently actuated from the control panel 160 by depression of respective buttons W1, W2 and W3 as described below.

A representative control panel 160 is shown in FIG. 7. Due to the high electrical power requirements of the heating elements, the electrical switching is preferably carried out by employing relays which are well known in the art to isolate the control panel buttons from the high voltage of the heating elements. For instance, depression of button S1 on the control panel 160 sends a low voltage signal to a relay to trigger that relay to close a high voltage switch, thereby supplying the requisite high voltage electrical power to the two pairs outer sleeve region heating elements 112*e*. Depressing button S1 a second time disengages the electrical connection and interrupts the supply of electric power to the outer sleeve region heating elements 112*e*. Similarly, depression of button W3 on the control panel 160 sends a low voltage signal to another relay to trigger that relay to close a high voltage switch, thereby supplying the requisite high voltage electrical power to the pair of inner waist electrical heating panels 112*f*. Depression of button W3 a second time disengages the electrical connection and interrupts the supply of electric power to the inner waist region heating panels 112*f*.

Accordingly, any or all of the heating element regions 112*a*-112*h* can be selectively energized and de-energized for differing runs by simply depressing one or more corresponding buttons on the control panel 160. The correlation between the buttons on the control panel 160 and the heating elements 112 which they control is illustrated in FIG. 12, wherein dark lines represent the control lines extending to the respective heating elements. As stated above, whichever region or regions of heating elements are actuated by depressing the appropriate button or buttons on the control panel 160, those heating elements will electrically cycle together with the central region heating elements 112*a*. This cycling is described in detail above with regard to the first embodiment of the invention.

As an example, if button S4 and W3 are depressed, then the chest region enlarging heating elements 112*b* and inner waist region heating elements 112*f* will have full electrical power supplied thereto together with the central region heating elements 112*a* upon each registration of a workpiece therebeneath. The power supplied thereto is then reduced, together with a simultaneous reduction in the power to the central region heating elements 112*a*, after passage of a predetermined curing period. Upon a subsequent workpiece registration, full curing power is again supplied to both the chest region enlarging heating elements 112*b* and inner waist region heating elements 112*f* together with the central region heating elements 112*a*.

Figure 8:
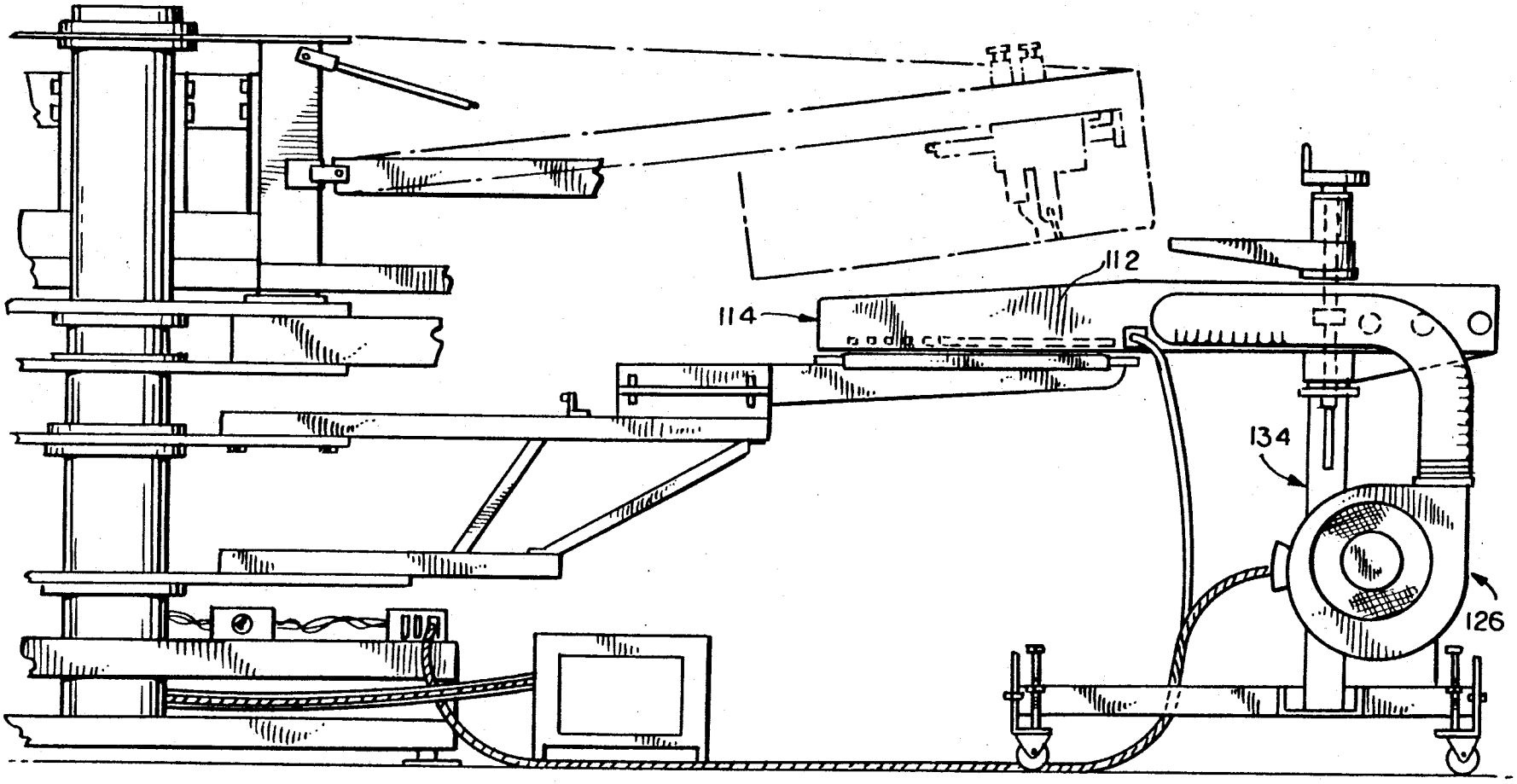
FIG. 8 is a side elevational view of the curing apparatus of FIG. 6 positioned at a press.

Thus, in operation of the curing apparatus of this preferred embodiment, the curing apparatus is wheeled into the desired position about the periphery of a press and electrically connected to the press, as shown in FIG. 8 and described above in detail with respect to the first embodiment. Then the appropriate buttons on the control panel 160 are depressed as dependent upon the size, shape and location of the print to be cured. Then the curing apparatus 110 is turned on to the low voltage position, upon which low voltage is supplied to the central region heating elements 112*a* and whichever other heating element regions are selected. Thereafter, the press is started up and upon registration of a first printed workpiece 120 beneath the heating elements 112, full curing voltage is supplied to the central region heating elements 112*a* as well as whichever other heating element regions were selected. After the workpiece 120 has been subjected to curing beneath the heating elements operating at high voltage for a predetermined period sufficient to effect curing, the voltage to both the central region heating elements 112*a* and whichever other heating elements are chosen is then automatically reduced to a lower voltage until the occurrence of a subsequent workpiece registration upon which full curing voltage is again supplied to the selected regions.

While the invention has been described with reference to a preferred embodiment, it will be understood to those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. In an automatic screen printing machine apparatus for curing a workpiece on a stationary pallet of said automatic screen printing machine, comprising:

a frame having a portion adapted to be positioned over a pallet of the automatic screen printing machine;

heating means mounted to said frame in proximity with said workpiece for imparting heat thereto to effect curing thereof;

electrical signal means for receiving an electrical signal from said printing machine upon stationary registration of said workpiece beneath said heating means or upon initiating or restarting production of said apparatus;

voltage control means for selectively supplying high voltage suitable for maintaining the heating elements at a desired curing temperature and a lower voltage to said heating means corresponding to said electrical signal received by said electrical signal means;

blower means for selectively supplying and interrupting a flow of forced air between said heating elements and said stationary workpiece so as to prevent heat from said apparatus from significantly heating said workpiece during periods during which said lower voltage is supplied to said heating means; and blower control means for switching said blower means to supply and interrupt said forced air corresponding to said electrical signal received by said electrical signal means.

2. An apparatus, in accordance with claim 1, wherein said heating means is a low wavelength infrared heat source.

3. An apparatus, in accordance with claim 1, wherein each of said voltage control means and blower control means are controlled through a programmable control panel.

4. An apparatus, in accordance with claim 1, wherein said frame is mounted upon wheel means for providing portability to the apparatus whereby the apparatus may be wheeled to any desired location.

5. An apparatus, in accordance with claim 1, wherein said heating means is mounted on a horizontal arm, the height of which is adjustable upon the frame.

6. An apparatus, in accordance with claim 1, wherein said blower means includes a slotted opening to direct a sheet of air between the heating means and the workpiece.

7. An apparatus, in accordance with claim 6, wherein a plurality of said apparatus are mounted to said curing apparatus and are employed simultaneously.

8. An apparatus, in accordance with claim 1, further including a safety limit switching means for switching said blower means to its air supplying position, and said voltage control means to its lower supplying position after passage of a predetermined time in the absence of receipt of an electrical signal from said electrical signal means.

9. An apparatus, in accordance with claim 1, wherein said apparatus is used for curing paint applied to a substrate on a silk screen printing press.

10. In an automatically indexing screen printing machine an electrical resistance curing apparatus for curing a printed material on the automatically indexing screen printing machine while the printed material is stationary, comprising:

a frame;

electrical resistance heating means mounted to said frame in proximity with said printed material, for imparting heat to said printed material to effect curing thereof;

control means for controlling the voltage supplied to said electrical resistance heating means such that a first, predetermined high voltage suitable for achieving a predetermined curing temperature is supplied during periods in which curing is to be effected and, after a predetermined interval of time for curing in which the stationary printed material remains beneath the heating means, there is supplied a second, predetermined lower voltage blower means for selectively supplying and interrupting a flow of forced air between heating means and said printed material, whereby airflow is interrupted during the high voltage periods wherein curing is to be effected, and a flow of forced air is supplied during the lower voltage periods, so as to prevent heat from said apparatus from significantly heating said printed material during said lower voltage period wherein no curing is to be effected.

11. A method for curing printed material, comprising:

placing a heat source in proximity with said printed material;

supplying power to said heat source to heat said heat source to a predetermined heat level for a predetermined period to cure said printed material;

reducing said power supply to said heat source to reduce said heat level at the completion of said predetermined curing period, with said heat source remaining in proximity with said printed material;

blowing air between said heating source and said printed material during the period of reduced heat level to prevent further heating of the printed material situated in proximity with said heat source.

12. In a screen printing apparatus an apparatus for curing a workpiece on a stationary platen of screen printer apparatus, comprising:

a frame;

a plurality of electrical resistance heating elements mounted to said frame in proximity with said stationary workpiece for imparting heat thereto to effect curing thereof;

electrical signal means for receiving an electrical signal from a screen printing apparatus upon registration of said workpiece beneath said heating elements or upon restarting production after a termination of production;

voltage control means for selectively supplying a high curing voltage and a lower voltage to said heating means corresponding to said electrical signal received by said electrical signal means;

switching means to interrupt the supply of electrical power to a selective number of said heating elements, with only the remaining heating elements cycling between said high curing voltage and said lower voltage;

blower means for selectively supplying and interrupting a flow of forced air between said heating elements and said workpiece so as to prevent heat from said apparatus from significantly heating said workpiece during periods during which said lower voltage is supplied to said heating means; and blower control means for switching said blower means to supply and interrupt said forced air corresponding to said electrical signal received from said electrical signal means.

13. A curing apparatus in accordance with claim 12 wherein said plurality of heating elements are arranged in a T-shape.

* * * * *

UNITED STATES PATENT AND TRADEMARK OFFICE

CERTIFICATE OF CORRECTION

PATENT NO. : 5,249,255

DATED : September 28, 1993

INVENTOR(S) : Fuqua, et al.

It is certified that error appears in the above-indentified patent and that said Letters Patent is hereby corrected as shown below:

ON THE TITLE PAGE:

[73] Assignee: Change "Oshkos" to --Oshkosh--.

Column 5, line 9, change "twined" to --turned--.

Column 7, line 57, change "quarts" to --quartz--.

Column 12, line 53, after "region" insert --of heating elements 112a at a location corresponding to--.

Column 14, line 2, change "hating" to --heating--.

Column 15, line 26, after "pairs" insert --of--.

Column 15, line 55, change "button" to --buttons--.

UNITED STATES PATENT AND TRADEMARK OFFICE

CERTIFICATE OF CORRECTION

PATENT NO. :5,249,255

DATED :September 28, 1993

INVENTOR(S) :Fuqua, et al.

It is certified that error appears in the above-indentified patent and that said Letters Patent is hereby corrected as shown below:

IN THE CLAIMS:

Column 16, lines 57-58, change "elements" to --means--.

Signed and Sealed this

Seventeenth Day of May, 1994

*Attest:*

*Attesting Officer*

BRUCE LEHMAN

*Commissioner of Patents and Trademarks*